US007934296B2

(12) United States Patent
Okamoto

(10) Patent No.: US 7,934,296 B2
(45) Date of Patent: May 3, 2011

(54) BINDING BAND AND BINDING BAND SET

(75) Inventor: Isao Okamoto, Katano (JP)

(73) Assignee: Nichido Kogyo Kabushiki Kaisha, Osaka (JP)

( * ) Notice: Subject to any disclaimer, the term of this patent is extended or adjusted under 35 U.S.C. 154(b) by 700 days.

(21) Appl. No.: 11/597,828

(22) PCT Filed: May 23, 2005

(86) PCT No.: PCT/JP2005/009379
§ 371 (c)(1),
(2), (4) Date: Nov. 27, 2006

(87) PCT Pub. No.: WO2005/115867
PCT Pub. Date: Dec. 8, 2005

(65) Prior Publication Data

US 2008/0028576 A1 Feb. 7, 2008

(30) Foreign Application Priority Data

May 25, 2004 (JP) ..... 2004-154157
Apr. 27, 2005 (JP) ..... 2005-130116

(51) Int. Cl.
*F16L 33/00* (2006.01)

(52) U.S. Cl. ..... 24/16 PB; 24/339; 248/622; 248/63; 248/74.3; 248/68.1

(58) Field of Classification Search ..... 24/16 PB, 24/335, 339, 599.1, 336, 74.3; 248/62, 63, 248/68.1, 69, 74.3
See application file for complete search history.

(56) References Cited

U.S. PATENT DOCUMENTS

| | | | | | |
|---|---|---|---|---|---|
| 3,147,522 | A | | 9/1964 | Schumm | |
| 3,147,523 | A | | 9/1964 | Logan | |
| 3,206,813 | A | | 9/1965 | Schumm | |
| 3,206,814 | A | | 9/1965 | Schumm | |
| 3,339,247 | A | * | 9/1967 | Geisinger | 24/16 PB |
| 3,576,054 | A | * | 4/1971 | Rynk | 24/16 PB |
| 3,672,004 | A | | 6/1972 | Smith | |
| 3,837,047 | A | * | 9/1974 | Bunnell | 24/16 PB |
| 4,059,300 | A | * | 11/1977 | Moberg et al. | 292/322 |
| 4,272,047 | A | | 6/1981 | Botka | |

(Continued)

FOREIGN PATENT DOCUMENTS

CN 1468785 1/2004

(Continued)

OTHER PUBLICATIONS

Supplementary European Search Report for Application No. EP 05 74 1469, mailed Aug. 20, 2007.

(Continued)

*Primary Examiner* — Robert J Sandy
*Assistant Examiner* — Michael Lee
(74) *Attorney, Agent, or Firm* — Ditthavong Mori & Steiner, P.C.

(57) ABSTRACT

A binding band comprises a band part, a pendant hook part provided at one end of the band part, and an enclosed-wall part provided at the other end of the band part and having a passage through which the band part is vertically passed. The enclosed-wall part has a slit through which the band part is inserted into the passage from the side.

6 Claims, 9 Drawing Sheets

U.S. PATENT DOCUMENTS

| | | | | |
|---|---|---|---|---|
| 4,910,831 | A * | 3/1990 | Bingold | 24/16 PB |
| 4,951,362 | A | 8/1990 | Denemark et al. | |
| 5,438,736 | A * | 8/1995 | Terada et al. | 24/599.8 |
| 6,105,210 | A * | 8/2000 | Benoit | 24/16 PB |
| 6,109,673 | A * | 8/2000 | Olshausen | 292/307 A |
| 6,325,577 | B1 | 12/2001 | Anderson | |
| 6,772,488 | B1 * | 8/2004 | Jensen et al. | 24/599.6 |
| 7,334,299 | B2 * | 2/2008 | Assarsson | 24/16 PB |
| 7,540,069 | B2 * | 6/2009 | Okamoto | 24/16 PB |
| 2003/0088948 | A1 * | 5/2003 | Cook | 24/16 PB |
| 2003/0159254 | A1 * | 8/2003 | Wendle | 24/16 PB |
| 2005/0204515 | A1 * | 9/2005 | Hewes | 24/16 PB |

FOREIGN PATENT DOCUMENTS

| | | | |
|---|---|---|---|
| DE | 1231614 | B | 12/1966 |
| DE | 1235220 | B | 2/1967 |
| DE | 2046011 | | 4/1971 |
| DE | 77 24 913 | | 12/1977 |
| EP | 04 02 2225 | | 11/2004 |
| EP | 1 600 397 | A1 | 11/2005 |
| EP | 05 74 1469 | | 5/2007 |
| FR | 2 393 512 | A | 12/1978 |
| GB | J 21911 | | 3/1910 |
| GB | 691679 | | 5/1953 |
| JP | S38-16457 | | 8/1963 |
| JP | 48-26111 | | 8/1973 |
| JP | 5330200 | U | 3/1978 |
| JP | S60-50164 | | 4/1985 |
| JP | 60-160648 | A | 8/1985 |
| JP | 64-42269 | U | 3/1989 |
| JP | 5-648 | U | 1/1993 |
| JP | 5018377 | U | 3/1993 |
| JP | 5-29233 | U | 4/1993 |
| JP | 6-67917 | U | 9/1994 |
| JP | 7028923 | U | 5/1995 |
| JP | 8-322129 | A | 12/1996 |
| JP | 10318439 | | 12/1998 |
| JP | 11-109867 | A | 4/1999 |
| JP | 2001112605 | A | 4/2001 |
| JP | 2002-2622444 | A | 9/2002 |
| JP | 2003237823 | | 8/2003 |
| JP | 2004097324 | A | 4/2004 |
| WO | WO 97/37557 | | 10/1997 |
| WO | 0121500 | A1 | 3/2001 |

OTHER PUBLICATIONS

International Search Report, Jun. 10, 2005.

* cited by examiner

BINDING BAND AND BINDING BAND SET

BACKGROUND OF THE INVENTION

1. Field of the Invention

The present invention relates to a binding band and binding band set and more particularly, it relates to a binding band and binding band set which can be hooked on a wall or a column.

2. Background Art

The conventional binding band is disclosed in Japanese Unexamined Patent Publication No. 2003-237823, for example.

The binding band comprises a band part having a plurality of long and thin teeth continuously provided in the longitudinal direction, and a framed buckle having a hole at one end of the band part, to which the band part is inserted and a locking tooth which engages with the tooth, at a part of the hole.

The above document (Japanese Unexamined Patent Publication No. 2003-237823) discloses a binding band in which a band part does not easily come off but can be pulled out by a simple operation.

The conventional binding band was constituted as described above. Although the band part of the binding band was devised in many ways, treatment after binding was not considered.

SUMMARY OF THE INVENTION

The present invention was made in view of the above problems and it is an object of the present invention to provide a binding band and a binding band set in which a desired arrangement can be made after an object is bound by the binding band.

A binding band according to the present invention comprises a band part, a connecting part provided at one end of the band part, and an enclosed-wall part provided at the other end of the band part and having a passage through which the band part is vertically passed, in which the enclosed-wall part has a slit through which the band part is inserted into the passage from the side.

Thus, the band part can be inserted into the enclosed-wall part through the slit and the binding band can be retained by a certain connecting apparatus provided separately through the connecting part provided on one end of the band part.

As a result, the binding band in which a desired arrangement can be made after an object is bound with the binding band.

Preferably, the slit has a first opening dimension, the band part comprises a neck part having a width dimension smaller than the first opening dimension and a band body having a third width dimension larger than the first opening dimension, and the passage has a width dimension larger than the third width dimension.

Further preferably, the connecting part has a fourth width dimension larger than the third width dimension.

The band body may be provided with a plurality of continuous teeth and the enclosed-wall part may be provided with a locking part to be engaged with the teeth.

It is preferable that the neck part is provided at one end of the band part and between the band body and the connecting part.

In addition, the connecting part may be a pendant hook part and the pendant hook part may be turned around the band part. In addition, the pendant hook part is preferably detachable from the band part.

Further preferably, the connecting part has a configuration that can be detachably connected to a predetermined connecting tool.

According to one embodiment of the present invention, the band body comprises a first band body provided on the side of the enclosed-wall part, and a second band body connected to the first band body.

A second neck part having the same width dimension as that of the first neck part may be provided between the first band body and the second band body.

The second band body may be provided with a stopper member preventing the whole second band body from passing through the passage.

According to another aspect of the present invention, a binding band set comprises a first binding band and a second binding band and a binding band connecting tool for connecting the first and second binding bands detachably. Each of the binding bands comprises a band part, a connecting part provided at one end of the band part and an enclosed-wall part provided at the other end of the band and having a passage through which the band is passed in the vertical direction, in which the enclosed-wall part has a slit through which the band part is inserted into the passage, and the binding band connecting tool connects the connecting part of the first binding band and the connecting part of the second binding band detachably.

Preferably, the binding band connecting tool comprises a first receiving opening detachably receiving the first binding band connecting part, and a second receiving opening detachably receiving the second binding band connecting part.

According to still another aspect of the present invention, a binding band comprises first and second neck parts having a first dimension, a first band body provided at a region sandwiched between the first and second neck parts and having a second width dimension larger than the first dimension, a second band body connected to the first band body through the second neck part and having a third width dimension smaller than the second width dimension, and an enclosed-wall part provided at the end of the second band body in the opposite direction to the first band body and provided with a passage having a dimension smaller than the second width dimension but larger than the third width dimension.

DESCRIPTION OF THE PREFERRED EMBODIMENTS

Figure 1:
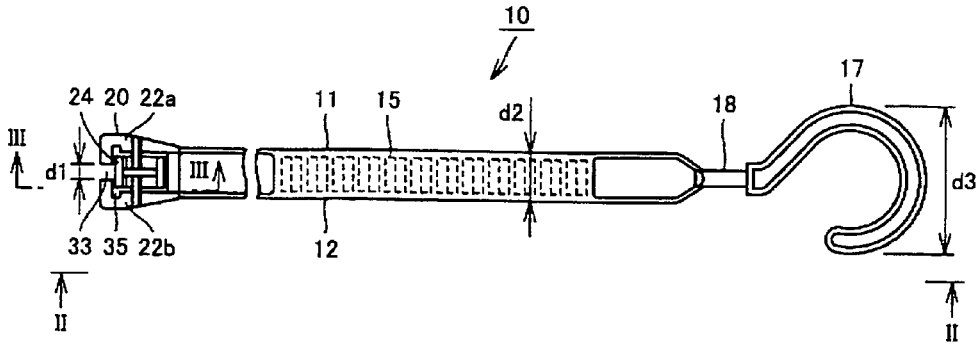
FIG. 1 is a plan view showing a binding band according to the present invention.
Figure 2:
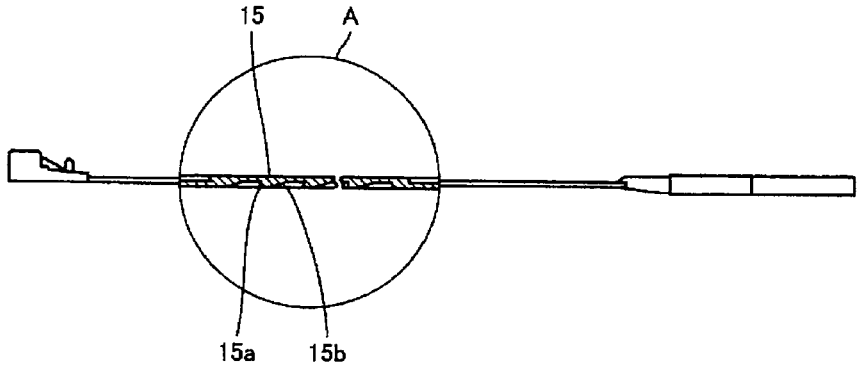
FIG. 2 is a side view showing the binding band according to the present invention.
Figure 3:
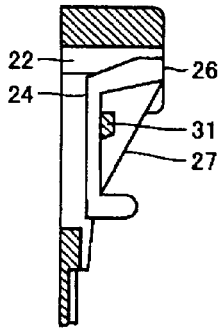
FIG. 3 is a view showing a detail of an enclosed-wall part.

Hereinafter, an embodiment of the present invention is described with reference to the drawings. FIG. 1 is a plan view showing a binding band according to one embodiment of the present invention, FIG. 2 is a sectional view taken from a part shown by arrows II-II in FIG. 1, FIG. 3 is a sectional view taken from a part shown by arrows III-III in FIG. 1. In addition, a part (shown by A) is enlarged so as to be easily understood in FIG. 2.

Referring to FIGS. 1 to 3, a binding band 10 comprises a band part 11, a hook part 17 provided at one end of the band part 11 as an example of a connecting part, and an enclosed-wall part 20 provided at the other end of the band part 11 and having a passage through which the band part 11 is passed in the vertical direction.

The band part 11 comprises a band body 12 and a neck part 18 provided on the side of the hook part 17 of the band part 11. The neck part 18 has a cylindrical shape and the band part 11 has a flat shape.

The band part 11 has a predetermined width d2 and a plurality of teeth 15 continuously provided in the longitudinal direction in the flat band body 12 as shown in FIG. 1. Referring to the part shown by A in FIG. 2, the tooth 15 has a vertical surface 15*a* perpendicular to the surface of the band body 12 and a slanted surface 15*b* which is gradually decreased in thickness toward the neck part 18.

The enclosed-wall part 20 has a passage 35 inside, through which the band part 11 is passed. A thickness dimension of the passage 35 is almost the same as that of the band part 11 or slightly larger than that. A slit 33 having a width dimension dl smaller than the width d2 of the band part 11 is formed at a tip end of the passage 35 in the enclosed-wall part 20. In order to form the passage 35 and the slit 33, the enclosed-wall part 20 comprises a pair of portal wall parts 22*a* and 22*b* which are oppositely provided at an interval. A space is provided between the pair of wall parts 22*a* and 22*b* and a locking part 24 is provided at the space.

The locking part 24 is elastically supported on the pair of wall parts 22*a* and 22*b* by a support part 31 in a state in which a space part is opened around. In addition, the locking part 24 is arranged so as to intersect with the passage 35.

Here, the width dl of the slit 33 is larger than that of the neck part 18. Therefore, the neck part 18 and the subsequent band body 12 of the binding band 10 are passed through the passage 35 of the enclosed-wall part 20 as will be described below with reference to FIGS. 4 to 6.

The locking part 24 has a locking tooth 26 which abuts on the vertical surface 15*a* of the tooth 15 provided in the band part 11. A rib 27 (refer to FIG. 3) is provided at the locking part 24 so as to retain the locking tooth 26 at a predetermined position with respect to the support part 31.

As described above, the tooth 15 provided in the band body 12 has the slanted surface 15*b* which is gradually increased in thickness from the neck part 18 and the vertical surface 15*a* succeeding to the slanted surface. When the band body 12 is passed through the passage 35, since it engages with the locking part 24 in the increasing order of thickness, an object can be easily bound by pulling the pendant hook 17 which was passed through the passage 35. In addition, once the object is bound and the tooth 15 engages with the locking tooth 26, it is difficult to release the engagement in the reverse direction.

Figure 4:
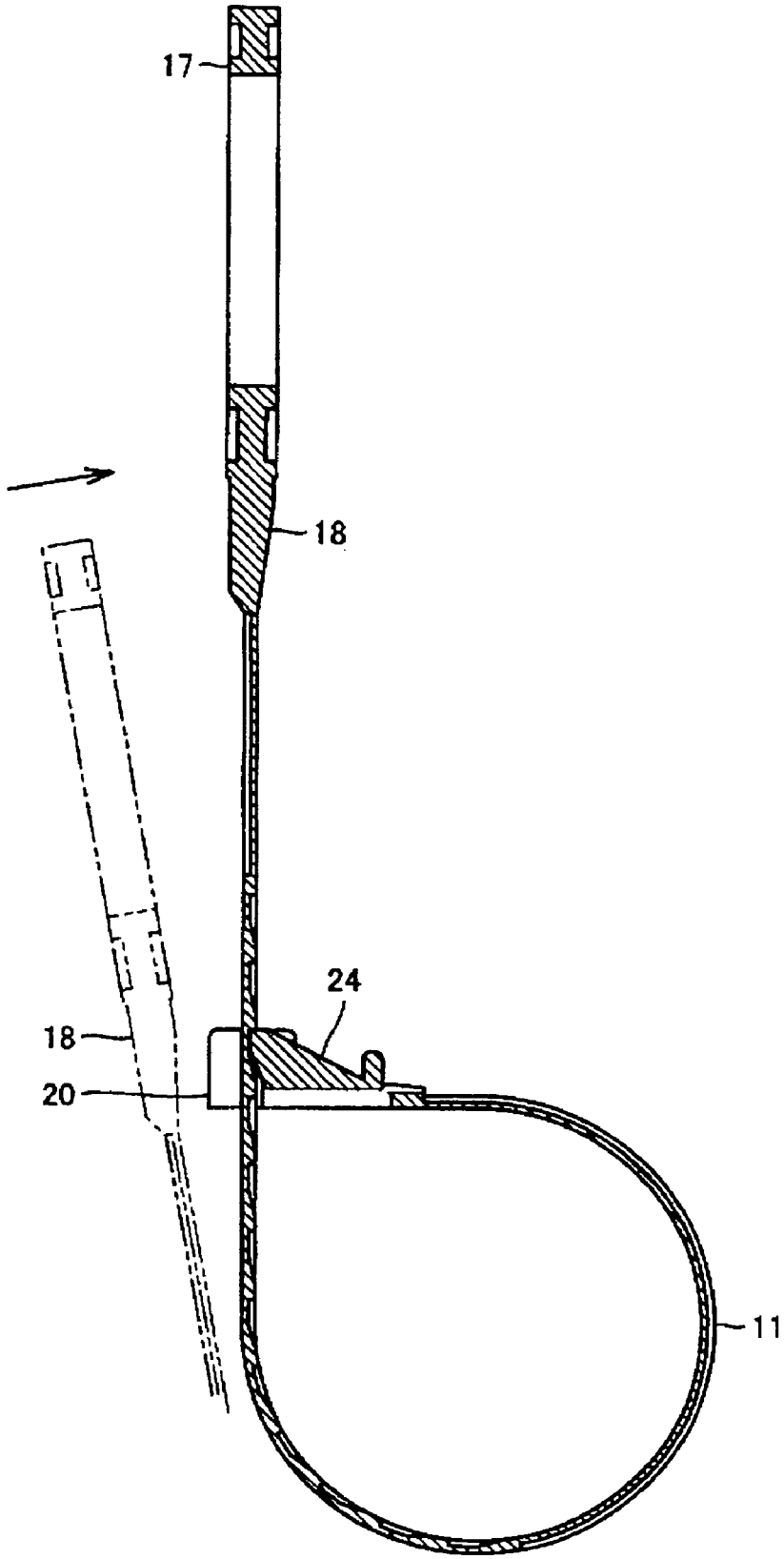
FIG. 4 is a view showing a state in which the binding band is used.

Next, a description is made of how to use the binding band having the hook part 17 as one example of the connecting part. FIG. 4 is a view showing a state in which the binding band 10 binds the object and the locking tooth 26 of the locking part 24 engages with the tooth 15 of the band part 11. As shown by an arrow in FIG. 4, the hook part 17 and the neck part 18 are brought close to the enclosed-wall part 20, and the neck part 18 is passed through the slit 33 and then the band body 12 is passed through the passage 35.

Figure 5:
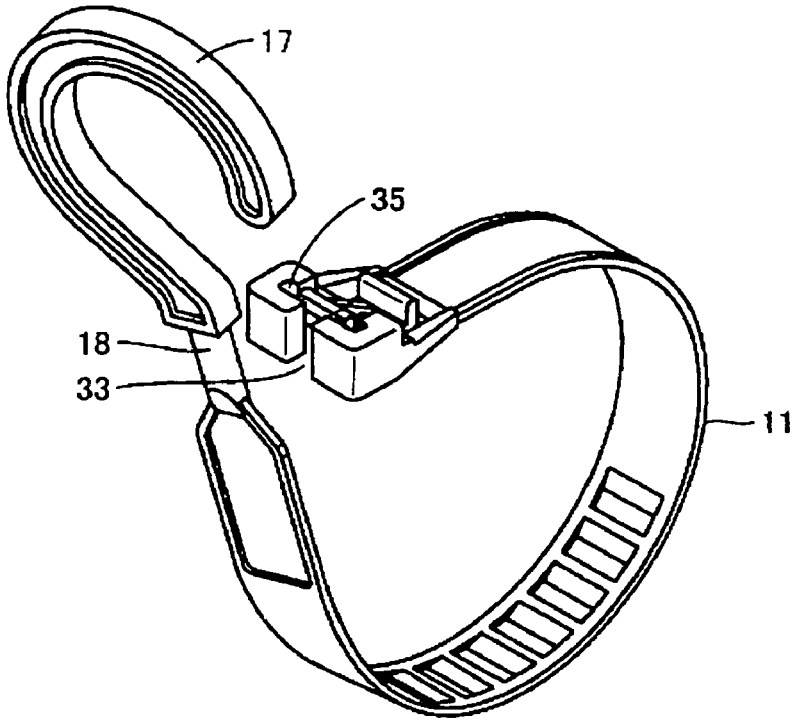
FIG. 5 is a view showing a procedure for passing a band part through the enclosed-wall part.

A concrete inserting method is described with reference to FIGS. 5 and 6. FIG. 5 is a view showing a state in which the neck part 18 of the binding band 10 is brought close to the slit 33 and FIG. 6 is a view showing a state in which the neck part 18 of the binding band 10 is passed through the slit 33.

Figure 6:
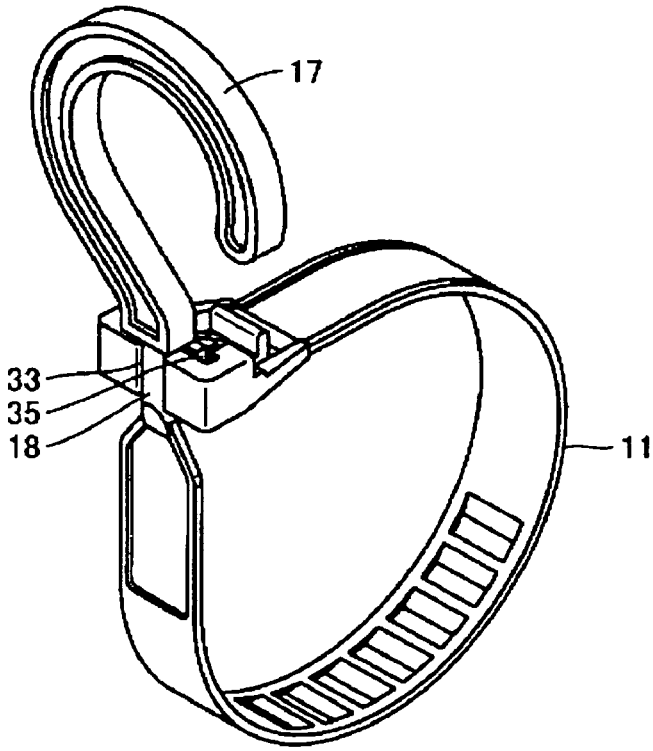
FIG. 6 is a view showing a procedure for passing the band part through the enclosed-wall part.

Referring to FIGS. 5 and 6, the neck part 18 of the binding band 10 is put in the slit 33 of the enclosed-wall part 20 and then the band part 11 is put through the passage 35. Then, the pendant hook 17 is pulled. As a result, as shown in FIG. 4, the band part 11 is integrated with the enclose-wall part 20. The object bound by the band part 11 is not shown.

Referring to FIG. 4, since the binding band 10 has the pendant hook part 17, the pendant hook part 17 can be hooked on any projection after the object is bound.

Next, the pendant hook part 17 is described. As shown in FIG. 1, the pendant hook part 17 is in the shape of a hook. Since the hook part 17 of the binding band 10 is hook-shaped, the binding band 10 can be hooked on any external convex part.

Figure 7:
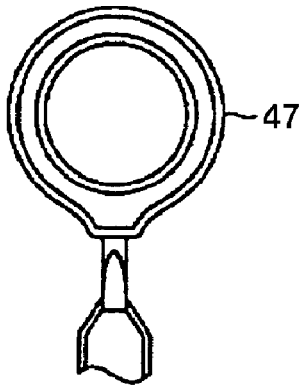
FIG. 7 is a view showing another embodiment of a pendant hook part.

In addition, instead of the hook-shaped pendant hook part 17, a ring-shaped pendant hook 51 may be used as shown in FIG. 7. In the case of the ring-shaped hook part 47 , the binding band 10 can be easily hooked on a projected nail, bar and the like and it is not liable to get unhooked even when it is shaken in some degree.

Although the pendant hook part 17 is in the shape of a hook on a flat surface of the band part 11 in FIG. 1, the present invention is not limited to this and the hook of the pendant hook part 17 may be faced in any direction with respect to the flat surface of the band part 11.

Figure 8:
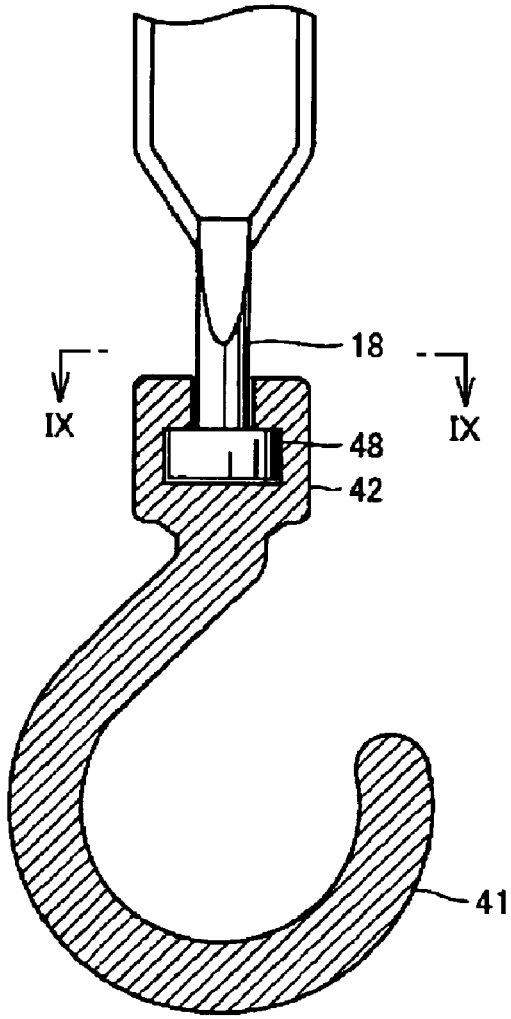
FIG. 8 is a view showing another embodiment in which the pendant hook part engages with a neck part.
Figure 9:
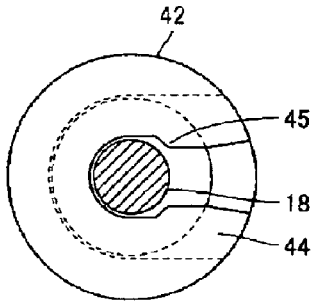
FIG. 9 is a view taken from a part shown by arrows IX-IX in FIG. 8.

Next, another embodiment of the present invention is described. FIGS. 8 and 9 show views of anther embodiment of the present invention. FIG. 8 is a sectional view showing a vicinity of a hook part 41 and a neck part 18 according to another embodiment, and FIG. 9 is a view taken from a part shown by arrows IX-IX in FIG. 8.

Referring to FIGS. 8 and 9, a neck supporting part 48 is provided as the connecting part and a pendant hook part 41 is provided using the neck supporting part 48. The pendant hook part 41 can be turned in any direction with respect to the neck part 18 and detached from the neck part 18.

Referring to FIGS. 8 and 9, the neck part 18 has a cylindrical neck supporting part 48 whose diameter is larger than that of the neck part 18, at its tip end. Meanwhile, the pendant hook part 41 has a hook part fixing part 42 at a part in which the fixing part 42 engages with the neck part 18.

As shown in FIG. 9, the hook part fixing part 42 has a neck part supporting part 44 for rotatably retaining the cylindrical neck supporting part 48 at the end on the side of the neck part 18. The neck part supporting part 44 is U-shaped so that the neck part 18 can be dismounted from one direction in its circumferential direction. In addition, a stopper 45 is provided at the neck part supporting part 44 so that the neck part 18 may not get out.

Since the neck part 18 and the pendant hook part 17 have such configurations, the pendant hook part 17 can be faced in any direction with respect to the direction of the flat part of the band part 11. Furthermore, the pendant hook part 17 may be mounted on the neck part 18 after the object is bound with the binding band and the bound object may be retained at any position.

Although the description was made of the example in which the pendant hook part is in the shape of a hook or a ring in the above embodiments, the present invention is not limited to the above shapes and any configuration may be employed provided that it can be retained at the outside.

Furthermore, the description was made of the case in which the neck part is cylindrical in the above embodiments, the present invention is not limited to this and it may be flat or have configuration changed from a flat shape to a cylindrical shape.

Still further, although the description was made of the case in which the locking tooth is locked after engagement with the tooth in the above embodiments, the present invention is not limited to this and it may be constituted so as to be unlocked and released.

Figure 10:
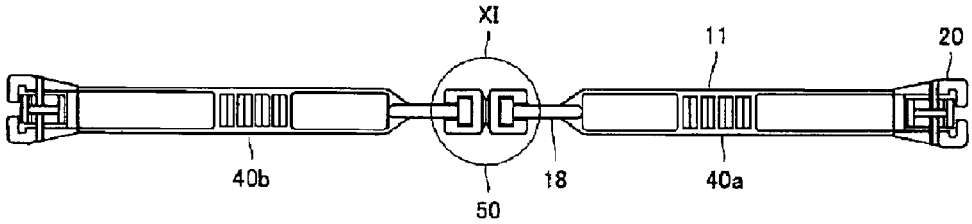
FIG. 10 is a view showing a binding band set in which two binding bands each having connecting parts are connected with a connecting tool.
Figure 11:
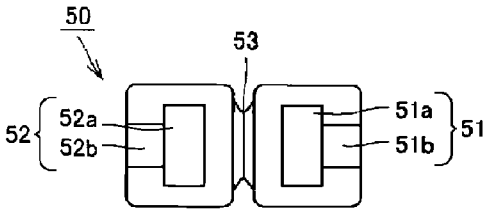
FIG. 11 is a view showing the connecting tool.

A still another embodiment of the present invention will be described hereinafter. According to this embodiment, a binding band set is provided by connecting two binding bands each having the neck supporting parts 48 as the connecting parts shown in FIG. 8 with a connecting tool. FIG. 10 shows the connected state. Referring to FIG. 10, two binding bands 40*a* and 40*b* are connected with a connecting tool 50. FIG. 11 shows the detail of the connecting tool 50. FIG. 11 is an enlarged view showing a part XI in FIG. 10. Referring to FIG. 11, the connecting tool 50 has a first receiving opening 51 detachably receiving a neck supporting part 48*a* of one binding band 40*a*, and a second receiving opening 52 detachably receiving a neck supporting part 48*b* of the other binding band 40*b*. The first receiving opening 51 and the second receiving opening 52 comprise neck supporting part receiving parts 51*a* and 52*a* receiving the neck supporting part 48 of the binding band 40, and neck part slits 51*b* and 52*b* receiving the neck part 18, respectively.

Figure 12:
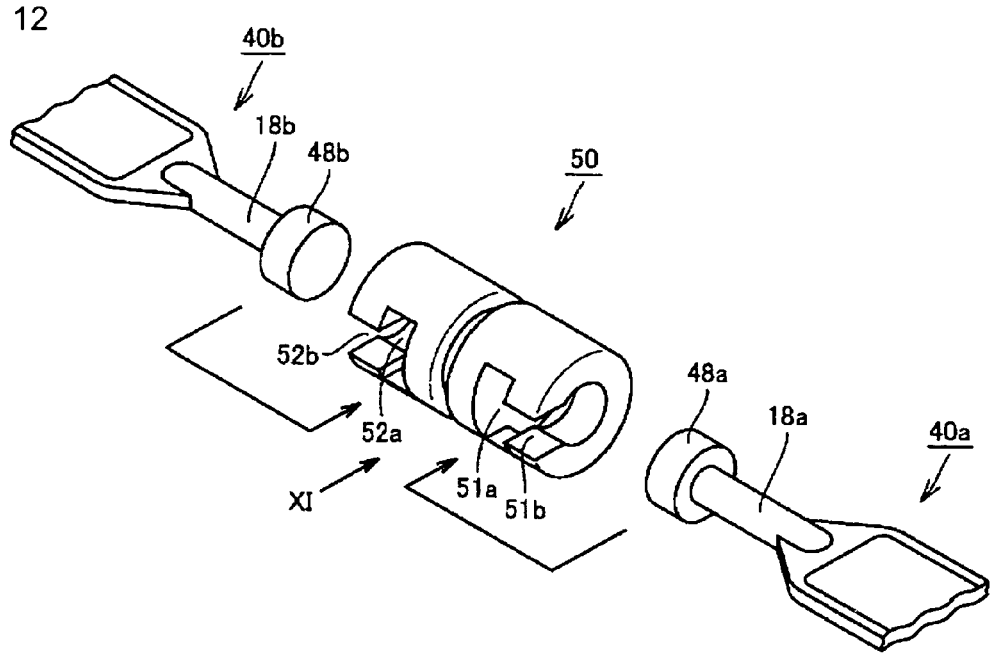
FIG. 12 is a view showing a method of connecting the connecting tool and the binding band.

FIG. 12 is a view showing a state in which the two binding bands 40*a* and 40*b* are to be connected to the connecting tool 50. As shown by an arrow in FIG. 12, the neck supporting parts 48*a* and 48*b* of the binding bands 40*a* and 40*b* are inserted into the receiving openings 51 and 52 of the connecting tool 50 from the direction in which the receiving openings 51 and 52 of the connecting tool 50 are provided so as to be connected, respectively.

Figure 13:
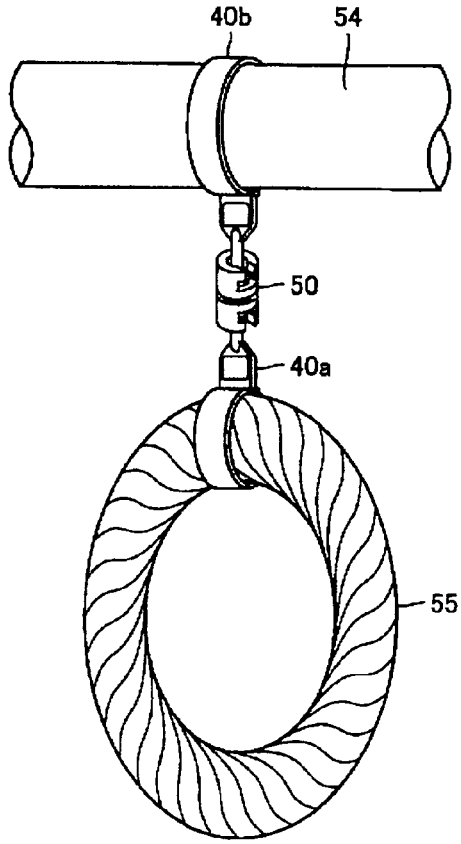
FIG. 13 is a view showing a method of using the binding band set.
Figure 14:
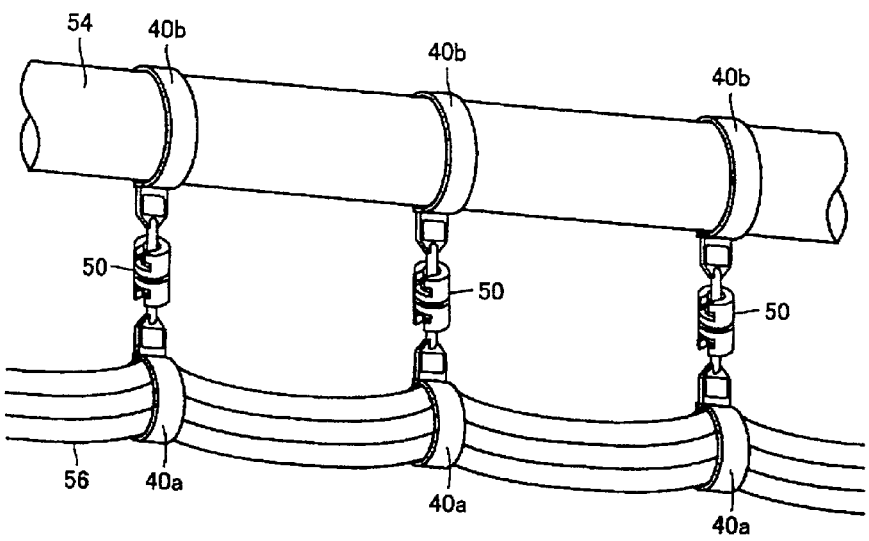
FIG. 14 is a view showing a method of using the binding band set.

Next, a concrete method for using the binding band set shown in FIG. 10 will be described. FIGS. 13 and 14 are views showing one example of the method of using the binding band set. As shown in FIGS. 13 and 14, the one binding band 40*b* is mounted on a hanging rod 54 previously. Then, a rope 55 and the like to be hung is bound by the other binding band 40*a*. Then, the binding band 40*a* binding the rope 55 and the like and the binding band 40*b* mounted on the hanging rod 54 are connected with the connecting tool 55.

FIG. 14 shows a case where an electric wire 56 and the like are bound by the binding band set shown in FIG. 10.

In addition, it is not needless to say that the binding band set can be used in any usage other than the above.

Figure 15:
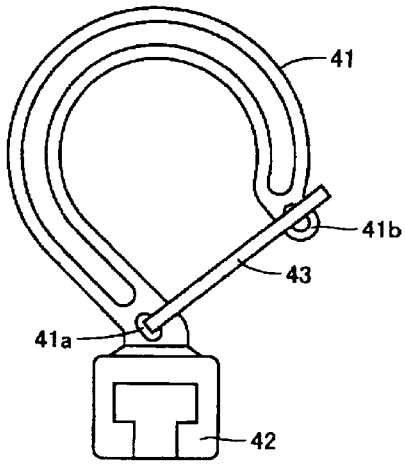
FIG. 15 is a view showing a pendant hook part provided with an expansion preventing ring.

Next, a method of preventing the pendant hook part 41 from expanding. According to the binding band 10 having the pendant hook part 41 shown in FIG. 1 or 8, the hook part 41 could expand because of lowering in strength of the pendant hook part 41 while it is hung and the hung object could fall. FIG. 15 is a view showing the pendant hook 41 provided with an expansion preventing ring 43 for preventing it. As shown in FIG. 15, a hole 41*a* is provided at the connecting part between the pendant hook part 41 and the hook part fixing part 42 and the ring 43 for preventing the expansion is provided such that it is passed through the hole 41 a and can be turned around the hole 41*a*. The other end of the expansion preventing ring 42 is engaged with an engagement projection part 41*b* provided at the end of the pendant hook to prevent the hook part 41 from expanding when the hook part 41 is hung.

Figure 16:
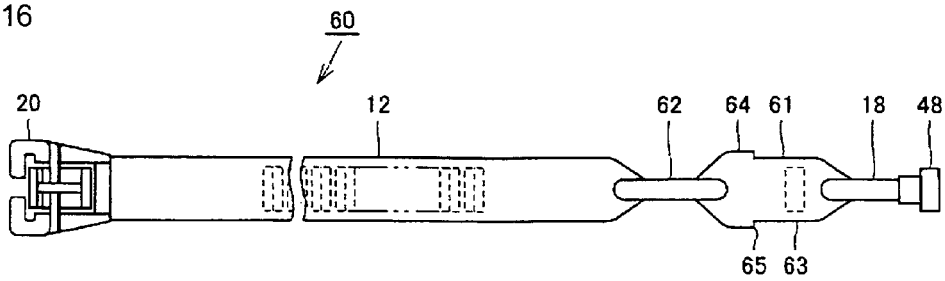
FIG. 16 is a plan view showing a binding band according to another embodiment.
Figure 17:
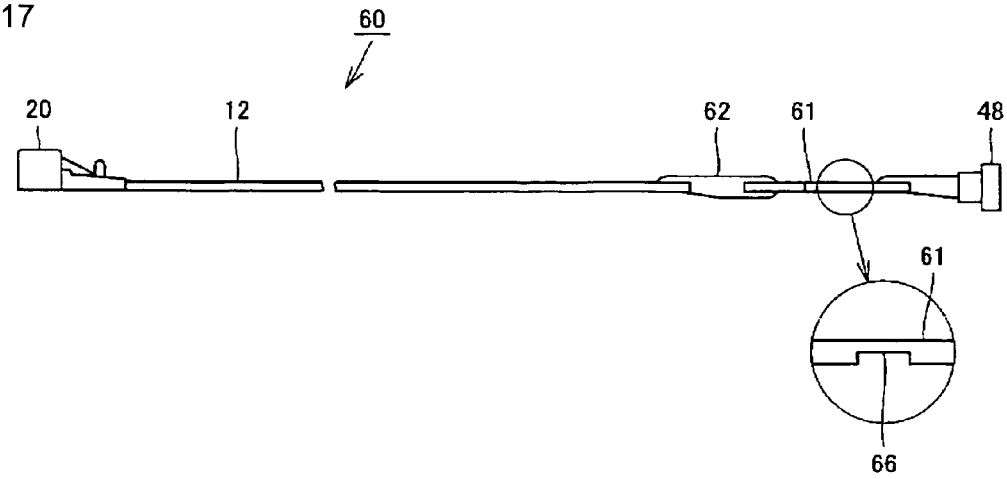
FIG. 17 is a side view showing the binding band according to another embodiment.

Next, a still another embodiment of the present invention will be described. FIGS. 16 and 17 are a plan view and a side view showing a binding band according to this embodiment of the present invention, respectively. Referring to FIGS. 16 and 17, a second neck part 62 and a second band body 61 are provided between the band body 12 and the neck part 18 of the binding band 40 shown in FIG. 10. Since the second band body 61 and the second neck part 62 are provided in this embodiment, the band body 12 and the neck part 18 in the above embodiment are referred to as the first band body and the first neck part, occasionally in the following embodiment.

Here, the configurations and dimensions of the second band body 61 and the second neck part 62 are the same as those of the first band body 12 and the first neck part 18. Therefore, the second neck part 62 can be passed through the slit 33 of the enclosed-wall part 20.

The second band body 61 has a passage part 63 having the same width d2 as that of the first band body 12, and a stopper part 64 having a width so as not to pass the passage 35, and a step part 65 is provided between the passage part 63 and the stopper part 64. In addition, a recess 66 is provided in the center of the second band body 61 to constitute a step part to be engaged with the locking part 24 (refer to a part surrounded by a circle pointed by an arrow in FIG. 17).

Next, a method of using this binding band 60 will be described. When the binding band 60 is inserted into the passage 35 of the enclosed-wall part 20 through the slit 33, the object bound by the binding band 60 can be squeezed and retained similar to that in the above embodiment. Meanwhile, even when the first neck part 18 is inserted into the passage 35 of the enclosed-wall part 20 through the slit 33, since the stopper part 64 preceding the step part 65 cannot pass the passage 35, the bound object can be retained without being squeezed. This state is shown in FIGS. 18A and 18B.

Figure 18A:
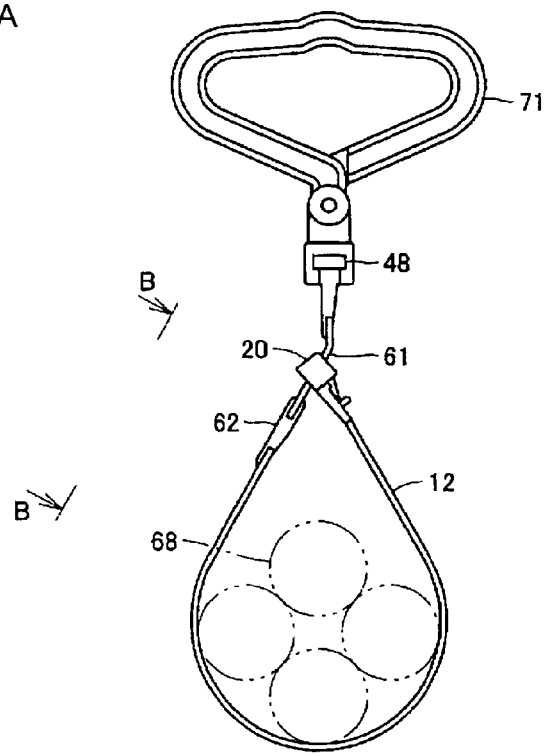
FIG. 18A is a view showing a used state of the binding band according to another embodiment.
Figure 18B:
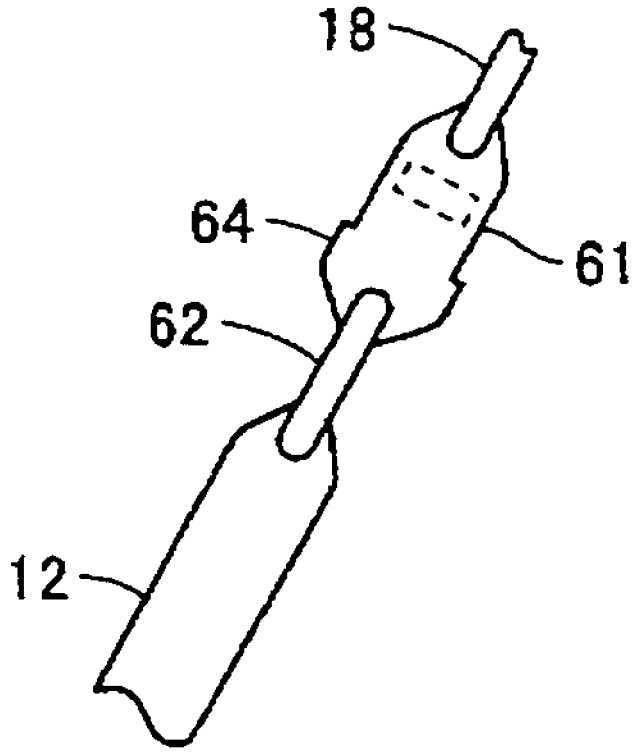
FIG. 18B is a view showing the used state of the binding band according to another embodiment.

FIG. 18A shows the state of the object 68 bound by the binding band 60 when the first neck part 18 is passed through the slit 33 of the enclosed-wall part 20, and FIG. 18B is a view taken from arrow B-B in FIG. 18A. As shown in FIG. 18A, according to this embodiment, a member 68 bound by the binding band 60 is hung loosely without being squeezed. In addition, in FIG. 18A, the neck supporting part 48 is detachably retained by a pendant member 71 that is large in width and has a configuration close to an ellipse.

As described above, according to this embodiment, since the two neck parts are provided in the binding band, the binding band can retain the bound member selectively whether the bound member is retained so as to be squeezed or retained without being squeezed by selecting either one of the two neck parts.

In addition, although the stopper part is provided such that the width of the second band body 61 is provided so as to be partially larger than that of the passage 35 in the above embodiment, the present invention is not limited to this and a stopper part may be provided such that the dimension of its thickness and the like is changed.

In addition, although the description has been made of the case where the length of the first band body is longer than that of the second band body in the above embodiment, the length of the first band body and the length of the second band body may be set to any dimension.

Although the embodiments of the present invention were made with reference to the drawings, the present invention may not be limited to the illustrated embodiments. Various kinds of modifications or variations can be added to the above embodiments in the same scope or the equivalent scope of the present invention.

The present invention can be advantageously used as a binding band which can be hanged on a wall or a column.

What is claimed is:

1. A binding band set comprising a first binding band and a second binding band and a binding band connecting tool for connecting said first and second binding bands detachably, wherein each of said binding bands comprises:

a band part;

a connecting part provided at one end of said band part; and an enclosed-wall part provided at the other end of said band part, and having a passage through which said band part is passed in the vertical direction, wherein said enclosed-wall part has a slit through which said band part is inserted into said passage; and said binding band connecting tool connects the connecting part of said first binding band and the connecting part of said second binding band detachably, wherein said binding band connecting tool is configured to provide for detachable connection, disconnection, and detachable reconnection of the connecting part of said first binding band and the connecting part of said second binding band.

2. The binding band set according to claim 1, wherein:

said slit has a first opening dimension, said band part comprises a first neck part having a second width dimension smaller than said first opening dimension and a band body having a third width dimension larger than the first opening dimension, and said passage has a width dimension larger than said third width dimension.

3. The binding band set according to claim 1, wherein said connecting part has a fourth width dimension larger than said third width dimension.

4. The binding band set according to claim 1, wherein a plurality of continuous teeth are provided in said band body, and said enclosed-wall part comprises a locking part which engages with said teeth.

5. The binding band set according to claim 1, wherein said first neck part is provided at one end of said band part and between said band body and said connecting part.

6. The binding band set according to claim 1, wherein said binding band connecting tool comprises a first receiving opening detachably receiving said first binding band connecting part, and a second receiving opening detachably receiving said second binding band connecting part.

* * * * *